United States Patent [19]

Philipp

[11] Patent Number: 4,508,032

[45] Date of Patent: Apr. 2, 1985

[54] GRAVURE PRESS

[76] Inventor: Wilfred Philipp, Lenbach Strasse 8, D 7014 Kornwestheim, Fed. Rep. of Germany

[21] Appl. No.: 393,778

[22] Filed: Jun. 30, 1982

Related U.S. Application Data

[63] Continuation-in-part of Ser. No. 122,996, Feb. 20, 1980, abandoned.

[30] Foreign Application Priority Data

Feb. 22, 1979 [DE] Fed. Rep. of Germany ..... 2906902
Apr. 12, 1979 [DE] Fed. Rep. of Germany ..... 2914878

[51] Int. Cl.[3] ..... B41F 1/16; B41M 1/40

[52] U.S. Cl. ..... 101/163; 101/41; 101/169

[58] Field of Search ..... 101/41, 42, 43, 44, 101/150, 158, 159, 160, 161, 163, 164, 169, 157, 287, 382 MV, 170; 430/307

[56] References Cited

U.S. PATENT DOCUMENTS 2,397,616 4/1946 Mullen .
2,405,513 8/1946 Mullen ..... 430/307 X
2,590,044 3/1952 Schaller .
2,937,085 5/1980 Seven .
3,453,110 7/1969 Delzenne et al. ..... 430/307 X
3,463,476 8/1969 Demosia et al. ..... 101/382 MV
3,512,970 5/1970 Millard ..... 430/307 X
3,842,738 10/1974 Terrazas et al. ..... 101/163 X
4,060,031 11/1977 Phillipp ..... 101/163

FOREIGN PATENT DOCUMENTS 426798 of 0000 United Kingdom .

*Primary Examiner*—J. Reed Fisher
*Attorney, Agent, or Firm*—Murray Schaffer

[57] ABSTRACT

The present invention is related to a gravure press, in particular for indirect gravure printing using a silicon rubber pad, which is first pressed upon the inked and wiped gravure plate to absorb ink and then pressed upon the material to be printed, comprising a mounting plate for a gravure plate, an inking device, a doctor blade and a drive mechanism for the silicon rubber pad, the inking device and the doctor blade. To permit the use of a low-priced plastic plate, the coat thickness of the light-sensitive top coat is equal to the engraving depths; the mounting plate has a microfinished surface, and the doctor blade is rigid and resistant to bending and designed in the form of a straight-edge.

7 Claims, 6 Drawing Figures

Fig. 1
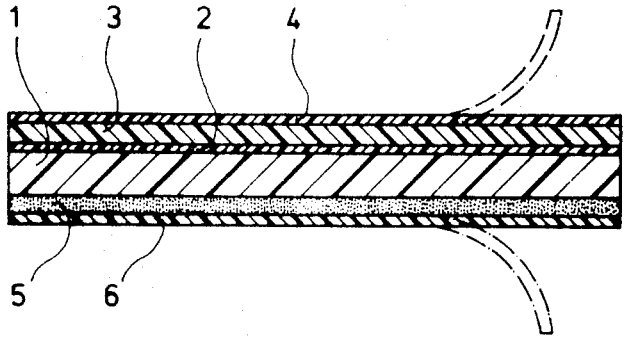
Fig. 2
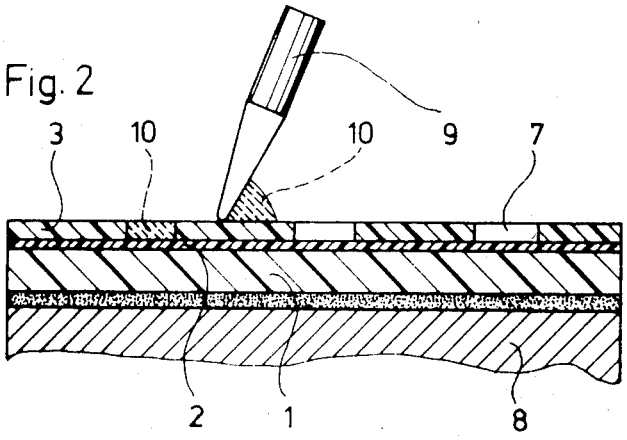
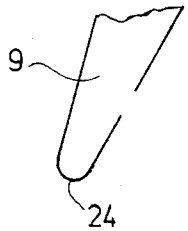
Fig. 3

GRAVURE PRESS

RELATED APPLICATION

This application is a continuation in part of application Ser. No. 122,996, filed Feb. 20, 1980, now abandoned.

BACKGROUND OF THE INVENTION

This invention relates to a gravure press, in particular for indirect gravure printing using a silicon rubber pad which is first pressed upon the inked and wiped gravure plate to absorb ink and then pressed upon the material to be printed, where all the ink is completely transferred due to the somewhat ink-repellent character of the pad surface, comprising a mounting plate for a gravure plate having a top coat of a light-sensitive plastic applied to a plastic film serving as substrate, further an inking device for applying ink to the plate which has an engraving depth of approx. 10 to 40μ, a doctor blade for wiping the inked plate, and a drive mechanism for the silicon rubber pad, the inking device and the doctor blade.

In this known printing process which is particularly suited also for printing curved surfaces and which offers the advantage that inks can be applied to provide good coverage, gravure plates of hardened steel are preferably used. These plates are engraved or etched, mostly line-etched. Depending on the subjects to be printed, the etching or engraving depth vary between 10μ and 40μ. However, the production of steel plates is extremely expensive. Instead of steel, zinc, copper, brass and even glass are used as materials for the plates. However, the production of these plates is expensive and complicated, and in addition highly toxic waste products are obtained in the production of these plates.

There have also been known plastic plates in which the individual halftone dots take the form of cup-shaped recesses which contours of circular cross-section. The quantity of ink retained during the wiping process in these recesses depends on the etching and washing depths. If well covered surfaces are to be obtained, neighbouring dots must run into each other during the printing operation. This is favored by the fact that the edge of the cup-shaped recesses is inclined in relation to the surface fo the gravure plate so that the material to be printed, which must however not be rigid but at least as resilient as paper, absorbs the ink from the cups. On the other hand, however, it is an undesired effect of these inclined edges that no sharp contours can be obtained because the ink tends to flow at the edges. In contrast, the printing method using a steel plate permits the use of relatively steep-walled line etchings so that prints with sharp contours can be obtained. The silicon rubber pad absorbs the ink under pressure from these recesses and transfers it to the material to be printed, which may also be completely rigid. As the ink does not run on the silicone rubber pad, printings of microscopic sharpness are obtained, and the coverage is also of a perfection which can otherwise be obtained only by screen printing.

Now, it is the object of the present invention to provide a gravure press using a gravure plate for printing which can be produced at considerably lower cost than the known plates, which will give good printing results and have a satisfactory service life in spite of the stresses to which it is subjected by the wiping process.

DESCRIPTION OF THE INVENTION

According to the invention, this problem is solved by an arrangement in which the coat thickness of the top coat is equal to the engraving depths, in particular approx. 10 to 40μ, the mounting plate for the plastic plate is level and has a microfinished surface and the doctor blade is rigid and resistant to bending and designed in the form of a straightedge.

The use of a plastic film, to which the top coat firmly adheres due to an adhesive layer provided therebetween and formed by roughening or by the application of a dull varnish, provides a gravure plate of satisfactory service life which can be produced at low cost and rapidly. Due to the fact that the coat thickness of the top coat is equal to the desired engraving depth, the printing obtained is of high intensity and good coverage because the engraved lines and dots have a rectangular cross-section so that they are capable of absorbing approximately twice the quantity of ink that can be absorbed by an etched dot or line of the same width, as the latter have an essentially triangular cross-section. In a preferred embodiment of the invention, the top coat consists of a polyvinylalcohol with diazo sensitizers. The use of such a top coat provides good resistance against the stresses encountered during the wiping process. However, special measures must be taken to ensure the adherence of the top coat to the substrate. For, following the exposure, the top coat is washed with water, and this operation requires a relatively high water pressure if the washing of the engraving is to be carried out with sufficient rapidity. Rapid washing in necessary in order to prevent the exposed coat from swelling and from getting unserviceable due to the formation of wrinkles. However, the necessary rapid washing can be achieved only with high water pressure, and this in turn can be used only if the top coat adheres firmly to its substrate. This is why the surface of the substrate is either roughened or provided with a dull varnish forming an adhesive layer. The use of a mounting plate with microfinished surface on the one hand and of a doctor blade which is resistant to bending, i.e. a rigid doctor blade, on the other hand, gives the above-described plastic plate a sufficient service life. For, the use of a conventional doctor blade, which can be adjusted and curved by means of screws—a process necessary in the case of the usual plates for adapting the doctor blade to the plate surface for the purpose of obtaining clean wiping results—would rapidly damage the surface of the plastic plates. However, given the fact that the mounting plate is absolutely level and that the plastic plate is of uniform thickness, a completely rigid doctor blade may be used. This is novel in gravure printing, where heretofore no clean wiping results could be obtained with a rigid doctor blade.

The substrate for the plate may for instance consist of a cellulose acetate comprising, if necessary, a plasticizer. In this case, the adhesive layer is produced by roughening. This can be carried out either by blasting with finest sand or else by using a die with correspondingly roughened bottom surface for the manufacture of the cellulose acetate film. The material used is preferably cellulose acetate. A triacetate film can also be used, just as a film on the basis of cellulose acetobutyrate or cellulose propionate. Suitable plasticizers include dimethyl phthalate.

An example of such a film is the cellulose acetate film "Ultraphan G" "einseitig matt" ("dull on one side"), having a thickness of 180μ and sold by Lonza-Werke GmbH, 7858 Weil am Rhein, Federal Republic of Germany.

The use of a top coat of polyvinylalcohol with diazo sensitizers offers the advantage that the washing process can be carried out with water alone so that the printer need not handle any dangerous or toxic substances when making his plate. An example of a suitable material for the top coat is as follows:

Azocol-S Siebdruckphotoschicht (screen printing photo layer) sold by Kissel and Wolf GmbH, 6908 Wiesloch, Fed. Rep. of Germany.

In another embodiment of the invention, the substrate consists of an essentially linear polyester, such as the "Clear Film" of DuPont Germany having a thickness of 180μ. and the adhesive layer consists of a dull varnish applied thereto. The dull varnish contains metal oxide particles having a particle size up to 20μ. Such a dull varnish may for instance contain particles of titanium oxide, aluminum oxide, silicon dioxide or zinc oxide. An example of a suitable dull varnish is as follows:

154,0 kg urea formaldehyde resin,
89,7 kg silicon dioxide,
4,7 kg titanium dioxide,
14,4 kg ethylene glycol,
20,6 kg ethyl alcohol
261,0 kg water These ingredients are mixed, thinned with water to 29.5 percent by weight; then there is added 12,5 kg saponin and the whole is brought to a pH value of 3.0 by adding formic acid.

To increase the adhesion between the dull varnish and the polyester film, the latter is preferably pretreated, for instance with a polyurethane resin or a resin to which a swelling agent for polyester has been added.

The bonding agent may also consist of thin coatings of multiplefunction isocyanates, such as toluene-2,4-diisocyanate, hexamethylene diisocyanate and 4,4'-diphenyl methane diisocyanate.

In another embodiment of the invention, the substrate is a polyester film of polyester of high molecular weight, such as the "Clear Film" of DuPont mentioned above on page 6, and the adhesive coat consists of a copolymerr of monomers such as methylacrylate, vinylidene chloride and itaconic acid, with some resorcin or pyrogallol added, if necessary, and the dull coat comprises hydrophobic, resin-link bonding agents with inorganic abrasives contained therein.

An example of a suitable composition for the dull coat is: that specified on top of page 7.

The above-described structure of the gravure plate of the invention permits the production of such plates at extremely low cost, and the printer himself is in a position to produce such a plate, which is resistant to wiping, by photographic transfer and subsequent washing with water. This renders the application of the printing process much more economical than ever before.

In a particularly preferred embodiment of the invention, the substrate to which the top coat is applied is of white color. This is particularly advantageous because the "developing of the engraved image" can be efficiently observed when washing the exposed top coat, even under unfavorable optical conditions, because the white color of the substrate will appear at all points where washing out has been effected down to the substrate. So, even unskilled persons are put in a position to produce satisfactory plates because they are warned to stop the washing process in time and, thus, to avoid the swelling of the exposed coat and the formation of wrinkles, which would make the plate unserviceable.

In a preferred embodiment of the invention, the mounting plate for the plastic plate consists of stone with a lapped surface. Stone offers the advantageous property that its surface will remain absolutely level even in the case of temperature variations.

Considering, however, that the production of stone mounting plates is relatively expensive, another embodiment of the invention has the mounting plate made of metal, in particular an aluminum alloy, provided with a thin top layer of a rubber-elastic material which is ground. This top layer of hard rubber also ensures that the surface remains absolutely level so that a satisfactory service life of the plate is obtained.

The use of a doctor blade which is resistant to bending and which takes the form of a rigid straight-edge ensures that the working edge of the doctor blade is and remains straight. The microfinished mounting plate provides an absolutely flat bed for the plastic plate, thus ensuring the absolute flatness of the latter's free surface. Now, when the doctor blade is aligned exactly parallel to the flat surface of the stone plate—this alignment can be adjusted and/or verified prior to mounting the plate on the mounting plate—the edge of the doctor blade will be in uniform contact with the plate surface throughout, as the plate surface will also remain absolutely flat at all times. Other advantages of the particular design of the invention of the mounting plate and the doctor blade are for instance that line etchings may be used instead of spot etchings as the ink is well retained by the link and not removed therefrom by the doctor blade. Thus, particularly good coverage is obtained.

In a preferred embodiment of the invention, the surface of the mounting plate is provided with a recessed circumferential channel communicating at least at one point with a bore which extends through the stone and which can be connected to a vacuum generator. This channel forms sort of a frame around the type area, i.e. the area of the gravure plate available for printing. A gravure plate which has been mounted to lie flat will remain stretched and flat during the whole time of operation, i.e. as long as the vacuum is maintained.

In a preferred embodiment of the invention, the circumferential channel provided in the mounting plate communicates with a net of crosswise extending grooves provided in the surface of the mounting plate, for instance in the rubber-elastic top layer. The channel together with these grooves hold the plate carefully but nevertheless permanently in an absolutely flat mounting position.

In order to avoid the need to adjust the parallelism between the doctor blade and the surface of the mounting plate with extreme accuracy or in order to eliminate the influence of minor inaccuracies, a preferred embodiment of the invention has the doctor blade resiliently mounted at the drive means moving it across the plate. However, this resilience is provided only by the doctor blade as a whole, while the latter in itself is still rigid.

Other details and improvements of the present invention will be apparent from the claims and from the following description of an embodiment of the invention with reference to the simplified and rigorously schematized drawings, in which FIG. 1 shows a cross-sectional view of a pre-sensitized plate for the production of a gravure plate;

FIG. 2 shows an exposed, washed, partly inked and wiped plate during the wiping process;

FIG. 3 shows an enlarged sectional view of a particularly suited doctor blade;

Figure 5:
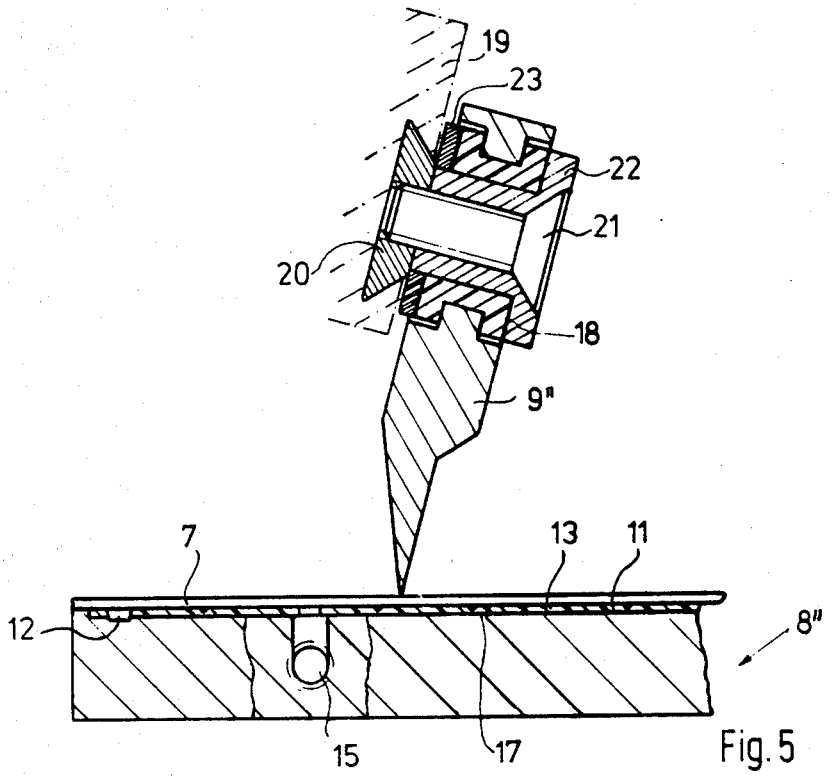
FIG. 5 shows a sectional view along line II-III of FIG. 4 with doctor blade.
Figure 4:
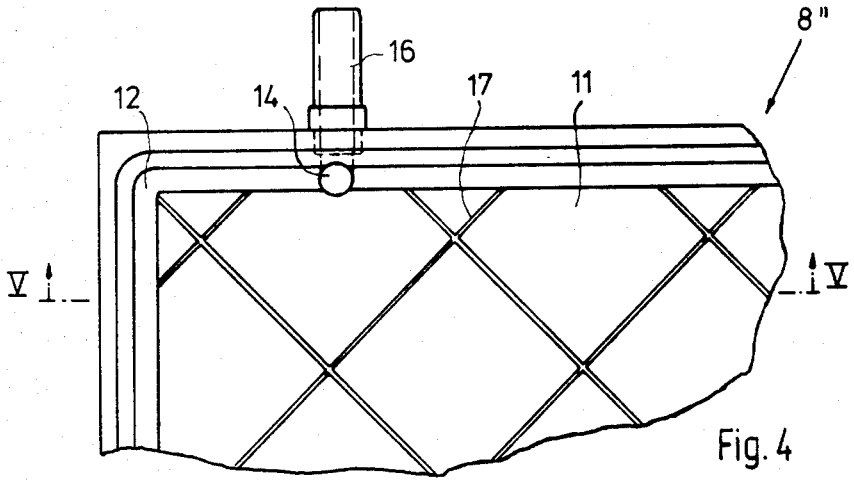
FIG. 4 shows a plan view of a mounting plate with circumferential channel.

In FIGS. 1 and 2, the thicknesses of the individual layers are much overdrawn in order to make the details better visible.

The cross-sectional view of the plate film shown in FIG. 1 shows a substrate 1 covered with an adhesive coat 2 which in turn is coated with a top coat 3 consisting of polyvinylalcohol with diazo sensitizers. The top coat 3 is covered by a light protection film 4 which, as indicated by dotted lines, is removed only prior to exposure. The bottom coat of the substrate 1 is provided with a coat of an adhesive 5 which is covered by a siliconized paper 6. The adhesive 5 is preferably of the pressure-responsive or pressure-activated type. For the purpose of producing a gravure plate, the light protection film 4 is removed, the desired subject is transferred by exposure to the top coat 3 and the latter is thereafter washed using a sharp water jet. This will remove the full thickness of the top coat right to the intermediate substrate. The contours between the washed-out and the prominent areas extend essentially vertical to the plane of the plate. Thus, the washed-out dots or lines have an essentially rectangular cross-section. During the printing process, the ink is retained in the washed-out lines or dots 7 in accordance with the image produced on the light-sensitive coat.

For use of the exposed and washed plate in the printing machine, the siliconized paper 6 is removed and the adhesive layer 5 is applied to a support 8 of the machine serving as plate mount.

During the printing operation, the ink is applied to the plate, and the doctor blade 9 acts on the one hand to press the ink 10 into the recessed lines or dots 7 and, on the other hand, to completely wipe off any excessive ink so that no ink remains on the surface of the wiped plate. Thereafter, a silicon rubber pad, which absorbs the ink from the recesses 7 and transfers it to the material to be printed, is applied in the known manner. The inking device for applying ink to the plate suitably consist of a brush 32 which is mounted on a horizontally shiftable carriage 36 in such a manner that the brush can be moved in a vertical direction. In its lower position, the brush dips into an ink container which is arranged on a table adjacent to the support 8. When the brush is moved over the plate, the brush applies ink to the surface of the plate.

The mounting plate 8 partly shown in FIG. 2 consists of a stone plate, for instance marble or an artificial stone, of a size which is essentially equal to that of the surface of the gravure plate. The stone plate has an approx. thickness of between 10 and 80 mm. In contrast, the mounting plate 8″ shown without gravure plate in the plan view of FIG. 5 consists of an aluminum alloy. Its surface carries a relatively hard rubber or elastic plastic top layer 13. The top layer 13 is surface-ground and provided with very narrow and shallow channels 17. Both the mounting plate of stone and the mounting plate of metal exhibit channels 12 provided at a small distance from their edges and essentially in parallel thereto. These channels 12 form a circumferential frame around the mounting area as such. This channel has preferably a flat rectangular cross-section or else a segmental cross-section, in which latter case the secant delimiting the circular segment extends in the plane of the surface. At one point, a bore extending essentially vertical to the surface 11 is provided in the bottom of the channel 12. This bore communicates with a bore 15 extending in parallel to the surface 11 and ending in one side face of the mounting plate 8 and/or 8″ where a fitting 16 is provided to connect the bore to a vacuum generator not shown in the drawing.

In operation, a plastic plate 7 is applied to the microfinished surface and, if necessary, flattened, with the vacuum generator switched off. Thereafter, the vacuum generator is connected or switched on so that a vacuum is produced in the channel 12 which exerts a suction effect on the plate so that the plate 7 is firmly retained in its flat position. The channel network 17 acts to uniformly retain the whole plate. Following the application of the ink, a rigid doctor blade 9 and/or 9″ which takes the form of a straight-edge resistant to bending, is moved across the inked gravure plate in the direction vertical to its longitudinal direction and parallel to the surface of the gravure plate 7. The doctor blade wipes off any excessive ink so that only the ink retained in the engraved recesses of the gravure plate 7 is left over. The active edge of the doctor blade which is in contact with the gravure plate 7, extends exactly in parallel to the surface of the mounting plate 8 and/or 8′ and in parallel to the surface of the gravure plate 7.

Figure 6:
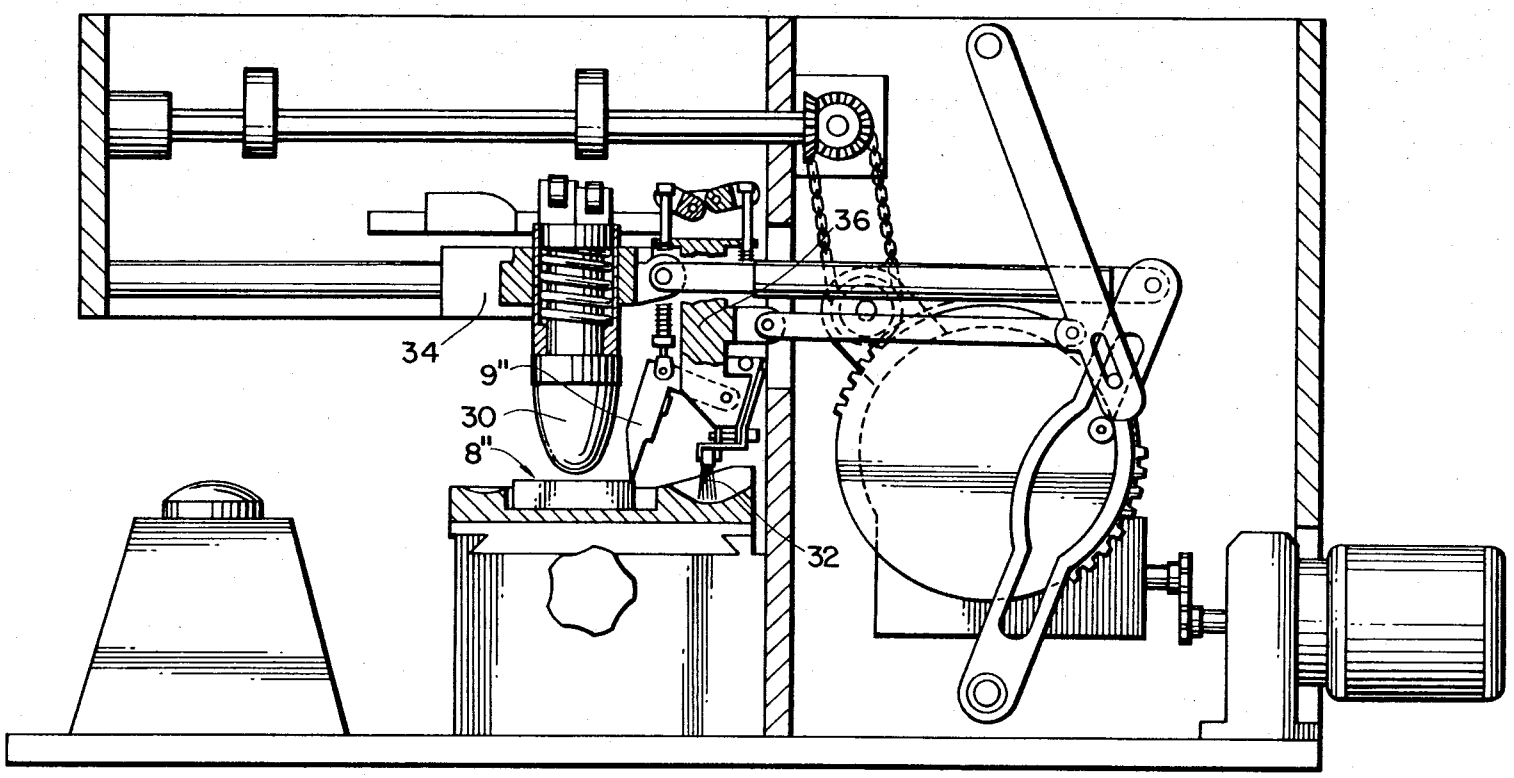
FIG. 6 is a sectional view through a gravure press incorporating the present invention.

The drive mechanism for driving the rubber pad, the inking device and the doctor blade is suitably that described in the inventor's U.S. Pat. No. 4,060,031, the technical teachings of which are incorporated herein by reference but which are shown schematically in FIG. 6. This driving mechanism comprises a horizontally shiftable carriage 34 which supports the vertically movable rubber pad 30, and a further horizontally shiftable carriage which carries vertically movably with respect to the carriage the brush 32 of the inking device and a carrier for the doctor blade 9.

In order to facilitate the adjustment of the parallelism between the doctor blade 9 and/or 90″ and the surface of the gravure plate 7, the doctor blade 9 is mounted to a beam 19 via a rubber-elastic intermediate layer 18. The beam 19 is part of and driven by the driving mechanism of the doctor blade. The beam 19 is provided with a dovetailed groove in which threaded guide sections 20 are provided. A screw 21 is screwed into each of the said guide sections 20 for fixing a flanged sleeve 22. The flanged sleeve 22 is enclosed by a coil-shaped rubber-elastic support 18 which positively holds the doctor blade 9″. A disk 23 performs the function of the flange of the flanged sleeve 22 at the opposite side. In view of the fact that the doctor blade in itself is rigid and resistant to bending, the straightness of the active edge is always maintained. The resilient support 18 or several of such supports, depending on the length of the doctor blade, permit a very small adaptation of the parallel alignment of the active edge of the doctor blade in relation to the surface of the gravure plate 7. Contrary to the usual design of doctor blades used in gravure printing, the active edge 24 of the doctor blade 9 and 9″ is preferably rounded with a radius of at least 0.05 to 0.1 mm. This arrangement helps to preserve the plate 7. The thickness of the top coat (13) depends on its shore A hardness. For instance, it may be 0.5 mm in the case of a shore A hardness of approx. 60, 0.8 mm 1.4 mm in the case of a shore A hardness of approx. 85.

What is claimed:

1. A gravure press for use in indirect gravure printing having a gravure plate seated on a mounting plate, an inking device for applying ink to the plate, a doctor blade for wiping the inked plate, a silicon rubber pad for transferring the ink to the material to be printed, and a drive mechanism for the silicon rubber pad, the inking device and the doctor blade, said drive mechanism being provided with a dovetailed groove having threaded guide sections, said guide sections containing a screw on which are mounted a flanged sleeve and a disk, said mounting plate being level and having a micro-finished smooth flat surface, said gravure plate comprising a thin sheet of uniform thickness coated with a light sensitive plastic containing a design in the form of washed out dots or lines, and having a thickness equal to the depths of said washed out dots or lines, said doctor blade being rigid, resistant to bending and having a straight-edge for wiping said gravure plate, and means mounting said doctor blade on said drive mechanism for securing and maintaining the straight edge of said doctor blade parallel to the flat surface of said gravure plate on contact of said doctor blade therewith, said means mounting the rigid doctor blade comprising a resilient support pad being held on and between said sleeve and said disk, the edge of said doctor blade opposite said straigth edge being seated in said support pad.

2. The gravure press in accordance with claim 1, wherein the cross section of the straight edge of the doctor blade has a radius of at least 0.05 to 0.1 mm.

3. The gravure press in accordance with claim 1, wherein the mounting plate is of metal having a coating of a rubber-elastic material which is ground and has a shore A hardness of 60 to 85.

4. The gravure press in accordance with claim 3, wherein said metal is an aluminum alloy.

5. The gravure press in accordance with claim 3, wherein the surface of the mounting plate is provided with a recessed circumferential channel provided at least at one point with a bore extending through a plate for connection to a vacuum genertator.

6. The gravure press in accordance with claim 5, wherein a network of crosswise extending grooves is provided in the surface of the mounting plate communicating with the circumferential channel.

7. The gravure press for use in indirect gravure printing having a gravure plate seated on a metal mounting plate carrying a thin top coat of rubber-elastic material which is ground and has a Shore A hardness of 60 to 85, the surface mounting plate being provided with a recessed circumferential channel provided at least at one point with a bore extending through the mounting plate for connection to a vacuum generator and a network of crosswise extending grooves provided in the surface of the top coat for communication with the channel an inking device for applying ink to the plate, a doctor blade for wiping the inked plate, a silicon rubber pad for transferring the ink to the material to be printed, and a drive mechanism for the silicon rubber pad, the inking device and the doctor blade, said mounting plate being level and having a micro-finished smooth flat surface, said gravure plate comprising a thin sheet of uniform thickness coated with a light sensitive plastic containing a design in the form of washed out dots or lines, and having a thickness equal to the depths of said washed out dots or lines, said doctor blade being rigid, resistant to bending and having a straight-edge for wiping said gravure plate, and means mounting said doctor blade on said drive mechanism for securing and maintaining the straight edge of said doctor blade parallel to the flat surface of said gravure plate on contact of said doctor blade therewith.

* * * * *